US009279606B2

(12) United States Patent
Kim

(10) Patent No.: US 9,279,606 B2
(45) Date of Patent: Mar. 8, 2016

(54) ACCUMULATOR HEAT EXCHANGER

(71) Applicant: INJE UNIVERSITY INDUSTRY-ACADEMIC COOPERATION FOUNDATION, Gimhae-si, Gyeongsangnam-do (KR)

(72) Inventor: Moogeun Kim, Gimhae-si (KR)

(73) Assignee: Inje University Industry-Academic Cooperation Foundation, Gimhae-si, Gyeongsangnam-do (KR)

( * ) Notice: Subject to any disclaimer, the term of this patent is extended or adjusted under 35 U.S.C. 154(b) by 269 days.

(21) Appl. No.: 13/988,571

(22) PCT Filed: Dec. 4, 2012

(86) PCT No.: PCT/KR2012/010443

§ 371 (c)(1),
(2) Date: May 21, 2013

(87) PCT Pub. No.: WO2013/089382

PCT Pub. Date: Jun. 20, 2013

(65) Prior Publication Data

US 2014/0069140 A1 Mar. 13, 2014

(30) Foreign Application Priority Data

Dec. 16, 2011 (KR) ..... 10-2011-0136332

(51) Int. Cl.

| | |
|---|---|
| ***F25B 41/00*** | (2006.01) |
| ***F25B 43/00*** | (2006.01) |
| ***F25B 40/00*** | (2006.01) |

(52) U.S. Cl.

CPC ..... *F25B 43/006* (2013.01); *F25B 40/00* (2013.01); *F25B 2400/051* (2013.01)

(58) Field of Classification Search

CPC .. F25B 2400/051; F25B 43/006; F25B 40/00; F25B 40/02

See application file for complete search history.

(56) References Cited

U.S. PATENT DOCUMENTS

| | | | | |
|---|---|---|---|---|
| 4,180,897 | A * | 1/1980 | Chester | 29/890.04 |
| 4,909,316 | A * | 3/1990 | Kamei et al. | 165/104.26 |
| 6,530,230 | B2 * | 3/2003 | Makizono et al. | 62/217 |
| 6,959,557 | B2 * | 11/2005 | Manole et al. | 62/149 |
| 7,690,219 | B2 * | 4/2010 | Suzuki et al. | 62/512 |
| 8,567,212 | B2 * | 10/2013 | Guitari | 62/503 |
| 2008/0127666 | A1 * | 6/2008 | Major | B60H 1/3227 62/244 |
| 2010/0218550 | A1 * | 9/2010 | Yoshioka et al. | 62/503 |

FOREIGN PATENT DOCUMENTS

| | | | | |
|---|---|---|---|---|
| JP | H 10019421 A * | 1/1998 | | F25B 43/00 |

* cited by examiner

*Primary Examiner* — Jonathan Bradford
*Assistant Examiner* — Elizabeth Martin
(74) *Attorney, Agent, or Firm* — Paratus Law Group, PLLC

(57) ABSTRACT

Disclosure relates to an accumulator heat exchanger. The accumulator heat exchanger is capable of guiding only a gas-phase refrigerant to a compressor by allowing a high pressure refrigerant passing through a condenser to pass through an accumulator and to be heat exchanged with a low pressure refrigerant, thereby promoting evaporation of a liquid-phase refrigerant.

4 Claims, 6 Drawing Sheets

ACCUMULATOR HEAT EXCHANGER

CROSS REFERENCE TO PRIOR APPLICATION

This application is a National Stage Patent Application of PCT International Patent Application No. PCT/KR2012/010443 (filed on Dec. 4, 2012) under 35 U.S.C. §371, which claims priority to Korean Patent Application No. 10-2011-0136332 (filed on Dec. 16, 2011), which are all hereby incorporated by reference in their entirety.

TECHNICAL FIELD

The present invention relates to an accumulator, and more particularly, to an accumulator heat exchanger capable of guiding only a gas-phase refrigerant to a compressor by allowing a high pressure refrigerant passing through a condenser to pass through an accumulator and to be heat exchanged with a low pressure refrigerant, thereby promoting evaporation of a liquid-phase refrigerant.

BACKGROUND ART

In a supercritical vapor compression cooling cycle using carbon dioxide or the like as a refrigerant, in order to increase a cooling capacity or prevent liquid compression by a compressor, use of an auxiliary heat exchanger for heat exchanging a high pressure refrigerant passing through a condenser with a low pressure refrigerant introduced into a compressor has been provided.

If such an auxiliary heat exchanger is further installed to a cooling system, problems, such as difficulty in an assembling work due to complexity of tubing of the cooling system, enlargement of the cooling system, and poor loadability, occur.

In order to solve the problems, an accumulator heat exchanger (AHX), in which an auxiliary heat exchanger is installed inside an accumulator, has been proposed.

Most of accumulator heat exchangers conventionally proposed have the configuration that a tube in which a low pressure refrigerant flows and a tube in which a high pressure refrigerant flows are in contact with each other and a plurality of plate-shaped fins are attached to an outer surface of each tube to increase a heat exchange area.

However, the accumulator heat exchanger having this configuration has low heat exchange efficiency since the heat exchange occurs only through the contact area between the refrigerant tubes.

DISCLOSURE

Technical Problem

The present invention is conceived to solve the aforementioned problems. An object of the present invention is to provide an accumulator heat exchanger capable of improving heat exchange efficiency by increasing a heat exchange area.

Technical Solution

According to an aspect of the present invention for achieving the objects, there is provided an accumulator heat exchanger, which include an accumulator housing; a heat exchanger made of metal including a cylindrical main body installed inside the accumulator housing and having upper and lower ends formed to be open, heat exchange bodies connected to each other inside the main body and formed in a honeycomb shape having polygonal cross sections and being open in a vertical direction, a plurality of tube insertion ports installed to penetrate the heat exchange bodies in the vertical direction and allowing a plurality of tubes in which a refrigerant flows to be inserted thereinto to be in contact with outer surfaces of the tubes; a high pressure refrigerant tube inserted into and coupled to two of the tube insertion ports of the heat exchanger in a U shape, the high pressure refrigerant tube allowing a high pressure refrigerant supplied from a condenser of a cooling cycle to flow therein; a low pressure refrigerant tube inserted through a bottom of the accumulator housing and passing through one of the tube insertion ports of the heat exchanger, the low pressure refrigerant tube having an upper end formed to be open to eject the low pressure refrigerant supplied from an evaporator of the cooling cycle into the accumulator housing; and a refrigerant gas exhaust tube having an upper end formed to be open at an upper side of the heat exchanger, the refrigerant gas exhaust tube being inserted into one of the tube insertion ports of the heat exchanger to guide refrigerant gas in the accumulator housing to a compressor of the cooling cycle.

Advantageous Effects

According to the present invention, a liquid-phase refrigerant contained in the refrigerant sent from the evaporator is first heat exchanged and evaporated while passing through the low pressure refrigerant tube, after ejected, second heat exchanged and evaporated when passing through the heat exchange bodies of the heat exchanger, and finally heat exchanged and evaporated in the refrigerant gas exhaust tube. Therefore, only the evaporated refrigerant gas is sent through the refrigerant gas exhaust tube.

In addition, the high pressure refrigerant flowing through the high pressure refrigerant tube is heat exchanged while passing through the heat exchanger in the accumulator and thus decreases in its temperature, which makes it possible to increase supercooling degree. Also, the refrigerant ejected from the evaporator is heat exchanged in the heat exchanger in the accumulator and thus increases in its temperature, which makes it possible to increase superheating degree.

BEST MODE

Hereinafter, preferred embodiments of an accumulator heat exchanger according to the present invention will be described with reference to the accompanying drawings.

Figure 1:
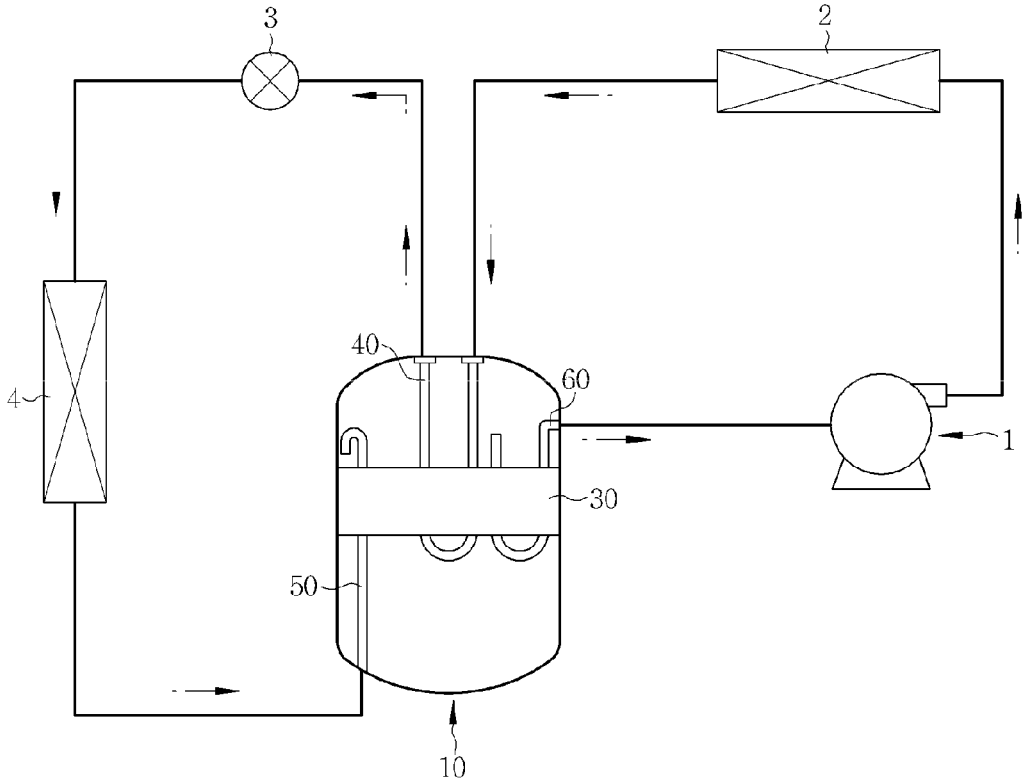
FIG. 1 is a view showing the configuration of a cooling cycle to which an accumulator heat exchanger according to the present invention is applied.

FIG. 1 is a view showing the configuration of a cooling cycle to which an accumulator heat exchanger according to the present invention is applied. The cooling cycle includes a compressor 1 for compressing a refrigerant at high temperature and high pressure to eject the compressed refrigerant, a condenser 2 in which the refrigerant ejected from the compressor 1 is heat exchanged, an expansion valve 3 for expending the high pressure refrigerant ejected from the condenser 2, an evaporator 4 in which the refrigerant passing through the expansion valve 3 is heat exchanged, and an accumulator 10 supplied with the low pressure refrigerant passing through the evaporator 4 and separating it into compressor working fluid, a liquid-phase refrigerant and a gas-phase refrigerant to send only the gas-phase refrigerant to the compressor 1.

Here, a high pressure refrigerant tube 40 for sending the high pressure refrigerant of the condenser 2 to the expansion valve 3 passes through a heat exchanger 30 provided inside the accumulator 10.

The accumulator 10 is provided with the heat exchanger 30, which promotes the evaporation of the liquid-phase refrigerant in the refrigerant passing through the evaporator 4 by using the heat of the high pressure refrigerant passing through the condenser 2 to make it possible to supply only the gas-phase refrigerant gas to the compressor 1 as well as to increase supercooling degree at an outlet of the condenser 2 and superheating degree at an outlet of the evaporator 4.

Figure 2:
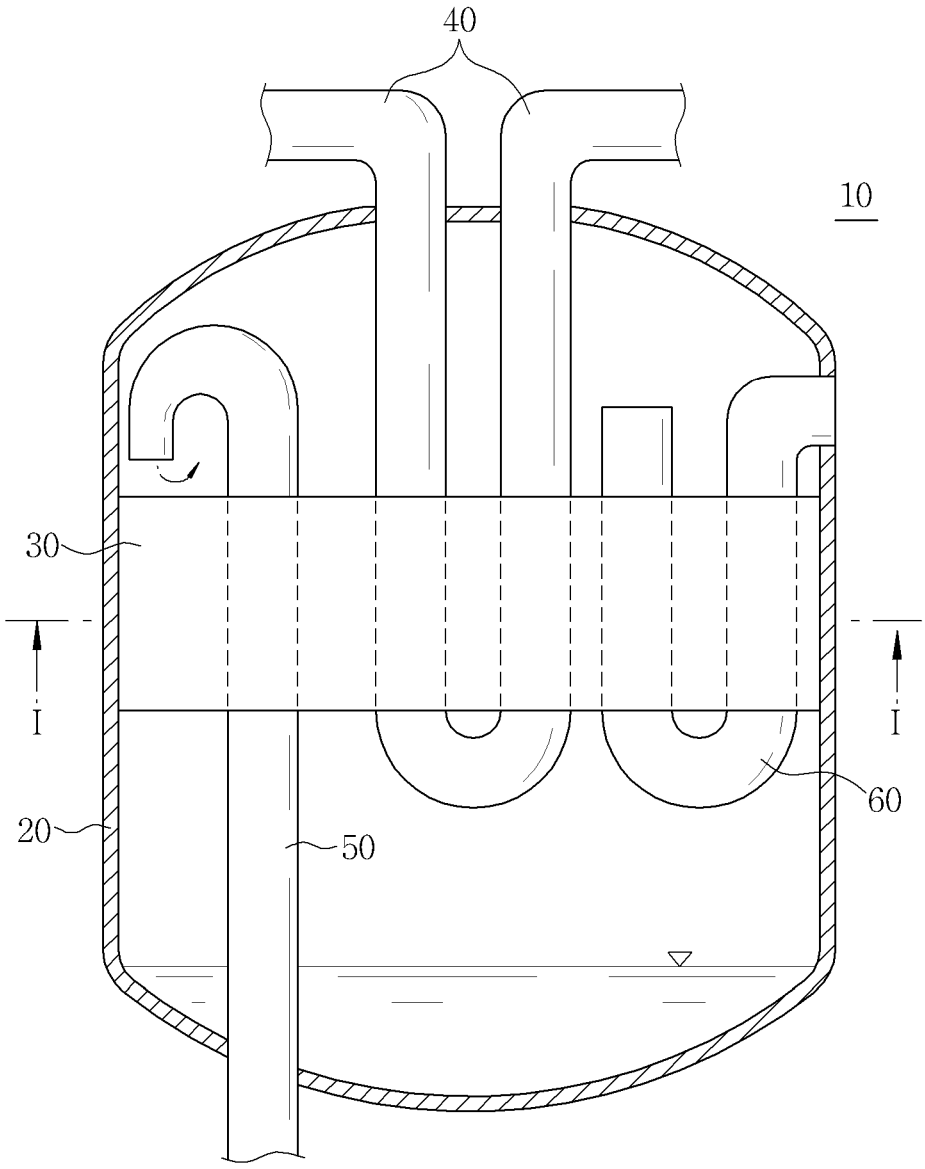
FIG. 2 is a longitudinal sectional view of an accumulator heat exchanger according to an embodiment of the present invention.
Figure 3:
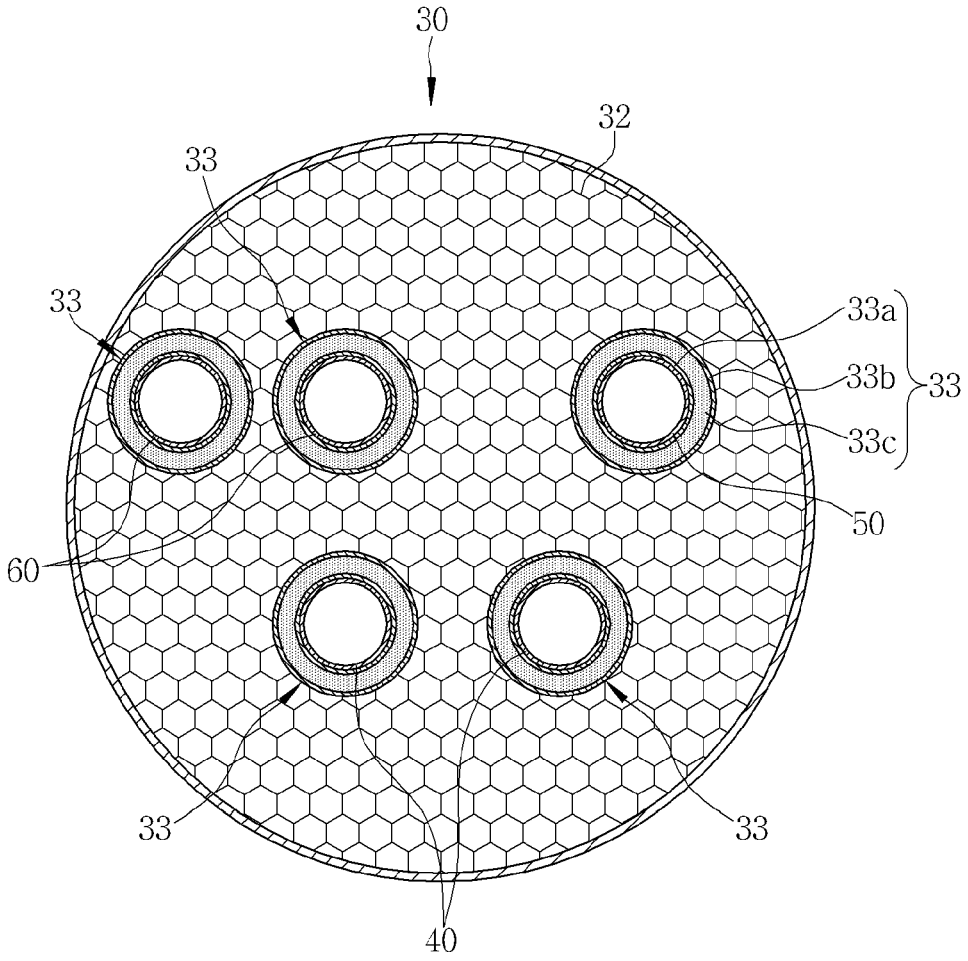
FIG. 3 is a sectional view taken along line I-I of FIG. 2.
Figure 4:
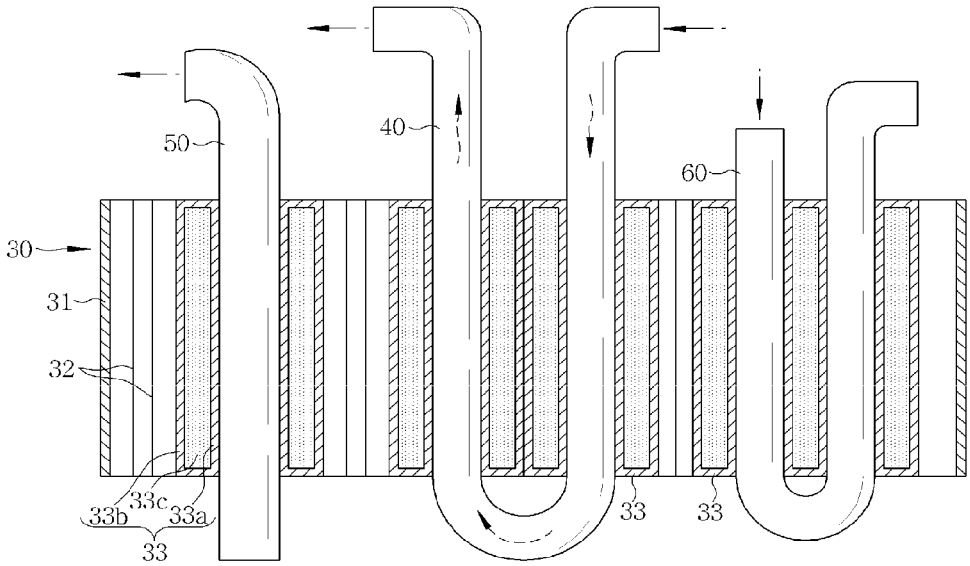
FIG. 4 is a longitudinal sectional view of a major portion cut and spread along a portion of a refrigerant tube to illustrate a coupling state between a heat exchanger and the refrigerant tube of the accumulator heat exchanger of FIG. 2.

Referring to FIGS. 2 to 4, the configuration and operation of the accumulator 10 according to the present invention will be described in more detail as follows.

The accumulator 10 according to the present invention includes an accumulator housing 20 having an approximately circular cylindrical shape, the heat exchanger 30 made of metal installed inside the accumulator housing 20, the high pressure refrigerant tube 40 inserted into and coupled to two of tube insertion ports 33 of the heat exchanger 30 in a U shape and having both ends respectively connected to the outlet of the condenser 2 (see FIG. 1) and an inlet of the expansion valve 3 (see FIG. 1), a low pressure refrigerant tube 50 inserted into and coupled to the heat exchanger 30 and having an outside end connected to the outlet of the evaporator 4 (see FIG. 1), and a refrigerant gas exhaust tube 60 inserted into and coupled to the heat exchanger 30 and having an outside end connected to an inlet of the compressor 1 (see FIG. 1).

The heat exchanger 30 includes a circular cylindrical main body 31 fixedly installed inside the accumulator housing 20 and having upper and lower ends formed to be open, heat exchange bodies 32 connected to each other inside the main body 31 and formed in a honeycomb shape having polygonal cross sections (e.g., hexagonal cross sections in this embodiment) and being open in the vertical direction, and a plurality of the tube insertion ports 33 installed to penetrate the heat exchange bodies 32 in the vertical direction and allowing the high pressure refrigerant tube 40, the low pressure refrigerant tube 50 and the refrigerant gas exhaust tube 60 to be inserted thereinto, respectively.

The high pressure refrigerant tube 40, the low pressure refrigerant tube 50, and the refrigerant gas exhaust tube 60 are mounted so that outer surfaces thereof are respectively in contact with inner surfaces of the tube insertion ports 33 to transfer or receive heat through the tube insertion ports 33.

The heat exchange bodies 32 each are formed in a polygonal column (e.g., a hexagonal column in this embodiment) of a metal material having superior heat conductivity. The plurality of heat exchange bodies 32 are installed in continuous contact with each other thereby constituting a honeycomb structure. If the heat exchange bodies 32 constitute the honeycomb structure as described above, as compared with a conventional heat exchanger having a plate fin structure, superior heat exchange performance can be obtained. There is a further advantage in that compressor working fluid and the liquid-phase refrigerant ejected from the low pressure refrigerant tube 50 smoothly pass through the heat exchange bodies 32 and fall, thereby easily collecting the compressor working fluid in a bottom of the accumulator housing 20.

Figure 5:
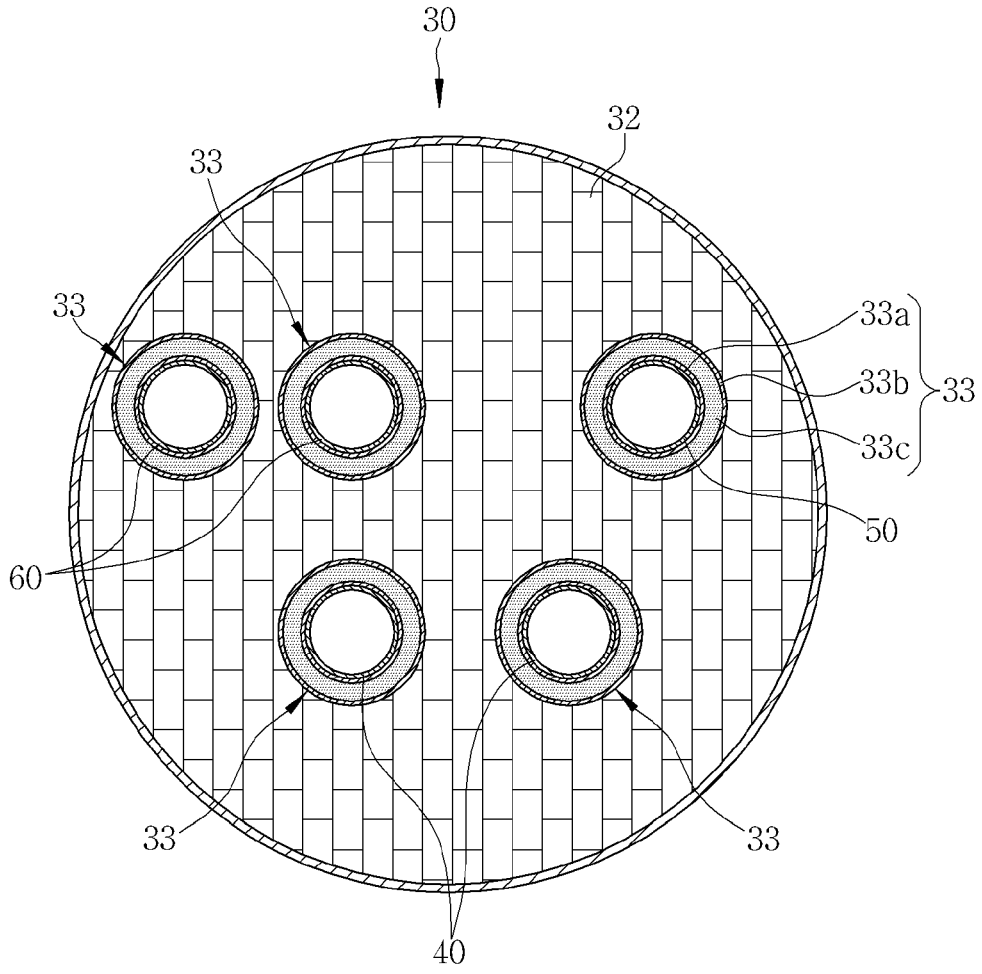
FIG. 5 is a transverse sectional view of an accumulator heat exchanger according to another embodiment of the present invention, corresponding to FIG. 3.

Although formed in a hexagonal honeycomb shape in this embodiment, the heat exchange bodies 32 may be formed in quadrangular cylindrical shapes by connecting a plurality of plates to each other as shown in FIG. 5.

Each of the tube insertion ports 33 includes a circular cylindrical tube having open upper and lower portions open. In this embodiment, the tube insertion port 33 has a dual tube structure having an inside tube 33*a* made of metal and an outside tube 33*b* made of metal installed outside the inside tube 33*a* to be spaced apart therefrom at a certain interval. A space between the inside tube 33*a* and the outside tube 33*b* is filled with a heat exchange material 33*c* having functions of heat exchange and heat storage. The inside tube 33*a* of the tube insertion port 33 has an inner diameter almost identical to an outer diameter of the high pressure refrigerant tube 40, the low pressure refrigerant tube 50, or the refrigerant gas exhaust tube 60. Thus, an inner surface of the inside tube 33*a* of the tube insertion port 33 is in contact with an outer surface of each refrigerant tube as a whole.

Figure 6:
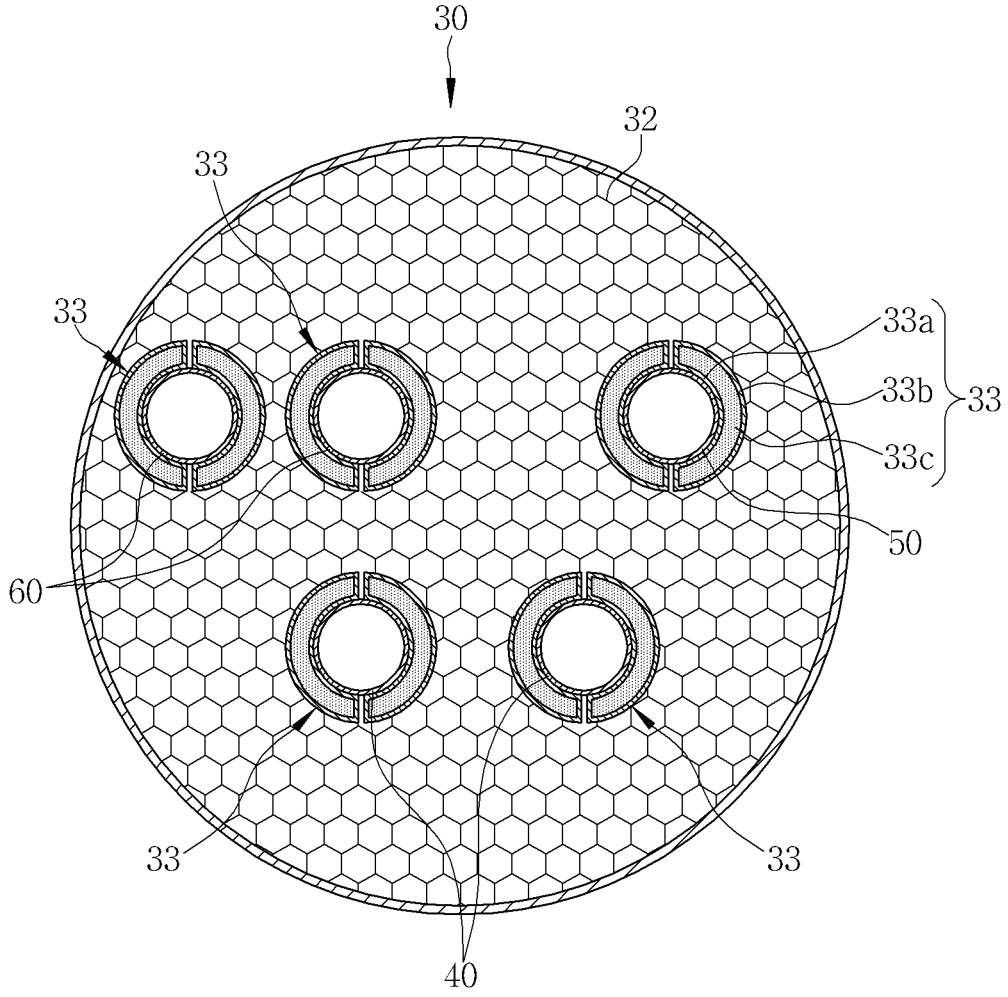
FIG. 6 is a transverse sectional view of an accumulator heat exchanger according to still another embodiment of the present invention, corresponding to FIG. 3.

In order to more increase a contact force between the outer surface of the high pressure refrigerant tube 40, the low pressure refrigerant tube 50 or the refrigerant gas exhaust tube 60 and the inner surface of the tube insertion port 33, the tube insertion port 33 may include two semi-circular cylindrical tubes separated from each other as shown in FIG. 6, so that elasticity of the heat exchange bodies 32 may enable the inner surface of the tube insertion port 33 to be brought into securely close contact with the outer surface of the high pressure refrigerant tube 40, the low pressure refrigerant tube 50, or the refrigerant gas exhaust tube 60.

The high pressure refrigerant tube 40 is inserted into and coupled to two of the tube insertion ports 33 of the heat exchanger 30 in a U shape, thereby transferring heat to the heat exchanger 30.

In addition, the low pressure refrigerant tube 50 is coupled to the heat exchanger 30 through a lower end of the accumulator housing 20. An upper end of the low pressure refrigerant tube 50 is formed to be open, so that the low pressure refrigerant supplied from the evaporator 4 of the cooling cycle (see FIG. 1) is ejected into the accumulator housing 20. In order to prevent foreign materials such as the compressor working fluid and the liquid-phase refrigerant ejected through the low pressure refrigerant tube 50 from flowing into the refrigerant gas exhaust tube 60, the upper end of the low pressure refrigerant tube 50 is preferably formed to be bent toward the direction opposite to the refrigerant gas exhaust tube 60.

The refrigerant gas exhaust tube 60 penetrates the heat exchanger 30 in a U shape and is coupled thereto. An upper end of the refrigerant gas exhaust tube 60 is formed to be open at an upper side of the heat exchanger 30.

The accumulator of the present invention as configured above operates as follows.

The high pressure refrigerant passing through the condenser 2 flows into the accumulator housing 20 through the high pressure refrigerant tube 40. While passing through the heat exchanger 30 of the accumulator housing 20, the high pressure refrigerant, which flows through the high pressure refrigerant tube 40 and has a relatively high temperature, transfers heat to the tube insertion ports 33 in contact with the high pressure refrigerant tube 40.

The heat transferred to the tube insertion ports 33 is transferred to the heat exchange bodies 32 in contact with the tube insertion ports 33, and then, the heat is gradually transferred to surroundings, whereby a temperature of the entire of the heat exchanger 30 is increased. In this case, since the tube insertion port 33 has the dual tube structure with the heat exchange material 33*c* embedded, it is possible to obtain superior heat exchange and heat storage effects from the heat exchange material 33*c*.

Meanwhile, the low pressure refrigerant, which has a relatively low temperature, is ejected through the low pressure refrigerant tube 50. At this time, since the low pressure refrigerant tube 50 passes through the heat exchanger 30, the liquid-phase refrigerant in the low pressure refrigerant is partially evaporated and then ejected to the outside.

The gas-phase refrigerant in the low pressure refrigerant ejected into the accumulator housing 20 through the low pressure refrigerant tube 50 flows into the refrigerant gas exhaust tube 60, and the liquid-phase refrigerant and the compressor working fluid flow down along the heat exchange bodies 32 of the heat exchanger 30. In this case, a portion of the liquid-phase refrigerant is evaporated by the heat exchange bodies 32 heated. The liquid-phase refrigerant not evaporated, the compressor working fluid and the like fall in the bottom of the accumulator housing 20 and are corrected.

The refrigerant gas evaporated in the accumulator housing 20 is sent to the compressor 1 through the refrigerant gas exhaust tube 60. At this time, a fine amount of the liquid-phase refrigerant may also flows into the refrigerant gas exhaust tube 60. Since the refrigerant gas exhaust tube 60 passes through the heat exchanger 30 in a U shape, the liquid-phase refrigerant flowing into the refrigerant gas exhaust tube 60 is evaporated while passing through the heat exchanger 30.

As described above, according to the accumulator of the present invention, the liquid-phase refrigerant contained in the refrigerant sent from the evaporator 4 is first heat exchanged and evaporated while passing through the low pressure refrigerant tube 50, after ejected, second heat exchanged and evaporated while passing through the heat exchange bodies 32 of the heat exchanger 30, and finally heat exchanged and evaporated in the refrigerant gas exhaust tube 60. Thus, only the evaporated refrigerant gas is sent through the refrigerant gas exhaust tube 60.

In addition, since the high pressure refrigerant flowing in the high pressure refrigerant tube 40 is heat exchanged and decreased in its temperature while passing through the heat exchanger 30, it is possible to increase supercooling degree.

Meanwhile, although it has been described in the aforementioned embodiment that each of the high pressure refrigerant tube 40, the low pressure refrigerant tube 50 and the refrigerant gas exhaust tube 60 has a circular cylindrical tube as an example, it may be formed of a generally rectangle- or track-shaped tube in order to make it easy to contact with the heat exchange bodies 32 and increase the contact area therebetween.

Although the technical spirit of the present invention has been described with reference to the accompanying drawings, the preferred embodiments of the present invention are described for illustrative purposes and not for limitation purposes. Also, it will be understood by those skilled in the art that various modifications and imitations may be made without departing from the scope of the technical spirit of the present invention.

INDUSTRIAL APPLICABILITY

The present invention may be applied to an accumulator of an apparatus using a cooling cycle, such as an air conditioner or a refrigerator.

The invention claimed is:

1. An accumulator heat exchanger, comprising:

an accumulator housing;

a heat exchanger made of metal and including:

a cylindrical main body installed inside the accumulator housing and having upper and lower ends formed to be open, heat exchange bodies connected to each other inside the main body to divide an inner space of the accumulator housing into an upper space positioned above the heat exchange bodies and a lower space positioned under the heat exchange bodies, the heat exchange bodies formed in a honeycomb shape having hollow polygonal cross sections being open in a vertical direction such that the upper space is in communication with the lower space, and a plurality of tube insertion ports installed to penetrate the heat exchange bodies in the vertical direction;

a high pressure refrigerant tube inserted into and coupled to two of the tube insertion ports of the heat exchanger in a U shape, the high pressure refrigerant tube allowing a high pressure refrigerant supplied from a condenser of a cooling cycle to flow therein;

a low pressure refrigerant tube inserted into the lower space under the heat exchange bodies through a bottom of the accumulator housing and passing through the heat exchange bodies from the lower space to the upper space via one of the tube insertion ports of the heat exchanger, the low pressure refrigerant tube having an upper end formed to be open at the upper space of the accumulator housing, the upper end of the low pressure refrigerant tube extending upwardly from the heat exchange bodies and then bent downward to face the heat exchange bodies to eject the low pressure refrigerant supplied from an evaporator of the cooling cycle into the upper space such that the ejected low pressure refrigerant flows from the upper space down to the lower space through the hollow polygonal cross sections of the heat exchange bodies; and a refrigerant gas exhaust tube having an upper end formed to be open at the upper space of the accumulator housing, the refrigerant gas exhaust tube being inserted into one of the tube insertion ports of the heat exchanger to pass through the heat exchange bodies and guide refrigerant gas in the accumulator housing to a compressor of the cooling cycle.

2. The accumulator heat exchanger according to claim 1, wherein each tube insertion port has a dual tube structure having an inside tube made of metal and an outside tube made of metal installed outside the inside tube to be spaced apart therefrom at a certain interval, a space between the inside tube and the outside tube being filled with a heat exchange material having functions of heat exchange and heat storage.

3. The accumulator heat exchanger according to claim 1, wherein each tube insertion port includes two semi-circular cylindrical tubes separated from each other to be in close contact with an outer surface of the high pressure refrigerant tube, the low pressure refrigerant tube, or the refrigerant gas exhaust tube.

4. The accumulator heat exchanger according to claim 1, wherein the refrigerant gas exhaust tube passes through the heat exchanger in a U shape; and the upper end of the low pressure refrigerant tube is formed to be bent toward a direction opposite to the refrigerant gas exhaust tube.

* * * * *